US005348030A

United States Patent [19]

Hirzel

[11] Patent Number: 5,348,030

[45] Date of Patent: Sep. 20, 1994

[54] RETRACTABLE BRUSH WITH UPWARDLY ANGLED TEETH

[76] Inventor: Suzy C. Hirzel, 933 Shellwood Way, Sacramento, Calif. 95831

[21] Appl. No.: 168,136

[22] Filed: Dec. 17, 1993

Related U.S. Application Data

[63] Continuation-in-part of Ser. No. 960,859, Oct. 14, 1992, abandoned.

[51] Int. Cl.[5] ..... A45D 24/10

[52] U.S. Cl. ..... 132/123; 132/118

[58] Field of Search ..... 132/118, 120, 121, 122, 132/123, 147, 232, 234, 235, 239; 15/105

[56] References Cited

U.S. PATENT DOCUMENTS

| | | | |
|---|---|---|---|
| 3,148,685 | 9/1964 | Haynes et al. | 132/123 |
| 3,224,454 | 12/1965 | Quinio et al. | 132/232 |
| 3,291,141 | 12/1966 | Quinio et al. | 132/122 |
| 3,381,693 | 5/1968 | Stevens | 132/123 |
| 3,974,841 | 8/1976 | Weisman | 132/123 |
| 4,314,137 | 2/1982 | Dörn | 132/122 |
| 5,133,372 | 7/1992 | Seja et al. | 132/239 |

*Primary Examiner*—Gene Mancene

*Assistant Examiner*—Frank A. LaViola

[57] ABSTRACT

The improved retractable brush for brushing, cleaning and curling hair of the present invention is substantially set forth in the abstract. The retractable brush is constructed with a brushing base, an elongated tube and, a pair of handles, upper and lower, which are joined by at their rear ends by "U" shape creating spring force. The brushing base has at least one or more rows of teeth/-bristles. The upper handle is connected to a brushing base with a slightly upward angle before assembled. When lower handle is in a horizontal figure from the side view, the base of the front is in its highest position. The connected area, between the handle and base is flexible enough to bend down when brushing base is in contact with inner surface of the tube after assembled. The lower handle is securely connected to the lower portion of the tube. The tube has a series of openings which align with the teeth/bristles. The spring force will automatically return the upper handle to the open position. When the front upper handle area is compressed by hand, the teeth will retract into the tube. This retractable brush method can be adapted for curling, brushing and cleaning brushes. Also, this method can be adapted for "Hot curling brushes".

5 Claims, 4 Drawing Sheets

RETRACTABLE BRUSH WITH UPWARDLY ANGLED TEETH

RELATED APPLICATION

The present application is a continuation-in-part of U.S. patent application Ser. No. 07/960,859filed Oct. 14, 1992 abandoned.

BACKGROUND OF INVENTION

The present invention is a combination of a hair brush and a curling device for human, animal, or synthetic hair. Also present invention can be used as a cleaning device.

PRIOR ART

The usual method for curling hair is a round brush, hot curling iron, or styling brush. However, with this method, it is necessary to unwind the brush to remove from the hair. This procedure often causes tangling, pulling, and damage to the hair.

There are several non-tangling retractable brushes that were invented. However, most of the prior retractable brushes are comprised of a two-step controlling method to retract the bristles/teeth, which involves sliding the controlling element horizontally and then pressing vertically on the controlling element (EXAMPLE: U.S. Pat. No. 4,226,251 by Albert Wall).

Some non-tangling retractable brushes incorporate a horizontal control mechanism (longitudinal direction) which, when actuated, causes the bristles/teeth retract (EXAMPLE: U.S. Pat. Nos. 4,191,200 and 4,596,261 by Frank J. Renda). The horizontal movement is very difficult, because of the awkward combination of thumb pressure and simultaneously sliding the control element with the thumb.

Some brushes are made of several controlling knobs which need two hands to operate, one hand to hold the brush and the other to turn/push the knob(s). This method is impractical for curling during the blow drying process, user needs a third hand, or has to put the dryer down, to adjust the knob(s).

Furthermore, to make the workable retractable brush/comb is to retract the teeth evenly and protrude teeth evenly. When base is approaching to stopping area (tube bottom) to retract, the base and tube bottom should generally be in the paralleled position. In order to achieve this, the base should start with a slight upward angle from the connection of the upper handle to base. Also, the base should be thinner at the connection area. If angle method is not used front base area teeth will retract lower than the end base. Example U.S. Pat. No. 3,974,841 (FIG. 2).

Another object of my invention is that tube and one of the handles is securely connected, so teeth will be in the track hole either while using or storing.

A further object of my invention is to make the spring force created by plastic handle.

There remains a need for an improved, one-step retractable brush which will brush, clean and curl the hair. Ideally, all above functions should be controlled in one motion, vertically, using only one hand/finger, without any awkward finger motion or position The apparatus should be simple, durable, inexpensive and efficient in performing the above described functions.

SUMMARY OF THE INVENTION

The improved retractable brush for brushing, cleaning and curling hair of the present invention satisfies all the foregoing needs.

The retractable brush is substantially set forth in the abstract. The retractable brush is constructed with a brushing base, spring force, a tube and a pair of handles, upper and lower, which are pivotally joined together at their rear ends.

The upper handle is connected to a brushing base with a slightly upward angle, approximately 2–12 degrees (before assembled). The connected area is noticeably thinner than the handle. The spring force to push up the base, however, weak enough to press by finger. Especially for children's and women's hands.

After assembled, the spring force is strong enough to push up the base to contact the top inner surface of the tube, soon as front panel of the base contacts the front inner surface of the tube, starting point of the upward angle of the connected area is starting to bend down. This will make the base generally paralleled position with the inner surface of the tube. Therefore, teeth will protrude generally even length of the exterior of the tube. Also, above method will create the paralleled position with base and the tube of inner surface while in the retracting process.

The lower handle is secured to the lower portion of the tube. The tube may be a round, square, oval, rectangular, or other shape. However, the applicant prosecutes a generally round and rectangular cylindrical tube for this application. The tube has a series of openings which align with the brush teeth. Another purpose for the openings are for circulating the hot air within the tube during the blow drying/curling process.

The brushing element resides within the cylindrical tube after assembled.

When the front upper handle area is compressed by hand the teeth will retract into the tube (closed position). Soon as lower base panel contacts the bottom tube surface or stopping element, the teeth tips will be flush or slightly under the exterior surface of the tube. The bottom inner tube surface (stopping element) and lower base panel surface should match for smooth stopping action. Another way to make the base to stop at the right position without loosing the tract opening, the independent stopping element can be inserted after tube and base was assembled. If later method used, the protective cap can be used as an independent stopping element.

The protective cap also may have a separating element. The separating element is for picking or separating the hair and also, can be used as an additional handle when curling.

The spring element serves a dual function. One of the functions is to make the upper handle and base automatically return to the open position and the second function is as a pressure-sensitive cushion when teeth are in contact with the scalp. This will prevent the scalp from being pinched, punctured, or scratched.

To use the present invention as a curling brush, the user winds the hair around the brush. After the curl is formed, pressing the upper handle against the lower handle in one motion. This method will allow the hair to be released from the bristles/teeth. The tube will then be able to slide out from the curled hair without having to unwind the curl. To clean the brush, press the upper handle against the lower handle. The hair or any lint will fall off from the exterior tube surface. Because of this easy cleaning method, the present invention can be applied to as a cleaning device. Example, combing/-brushing out the lint or hair from the carpet, cleaning the other brushes or combs, removing lints and/or hair from clothing.

This retractable brush method can be adapted for heating by electricity, butane, or battery to make "Hot iron", or "hot blow-drying curling brushes".

It is recommended that handles and separator of "Hot curling irons" be made of non-heating materials, while tube is made of a heat-conducting plastic or metal. For electric "hot curling irons" and "hot blow-drying curling brushes".

The present invention may have a locking element (any existing method or new invention by applicant in the future) to keep handles in the fully closed position, for storing or portability.

The assembly is inexpensive, simple, durable and efficient. Further features of the present invention are set forth in the following detailed description and accompanying drawings.

IN THE DRAWINGS

DETAILED DESCRIPTION

FIGURES 1, 2, 3, 4, 5, 6, 7, and 8

Referring more particularly to FIGS. 1, 2, 3, 4, 5, 6, 7, and 8 are first preferred embodiment of the "Improved Retractable Brush" of the present invention is schematically depicted therein, thus, 10 is shown, which is comprised of a tube 20, pair of handles, upper handle 11 and lower handle 12.

Figure 5:
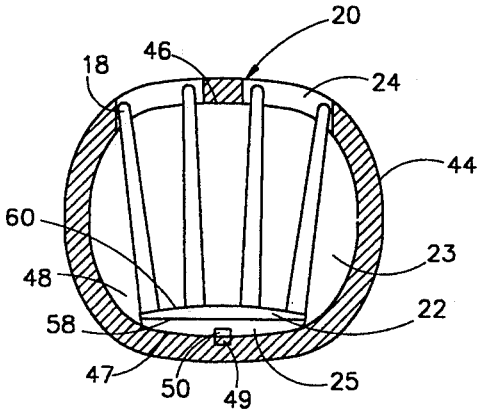
FIG. 5 is a front cross-view of the first preferred embodiment brush in the closed position (retracted).
Figure 7:
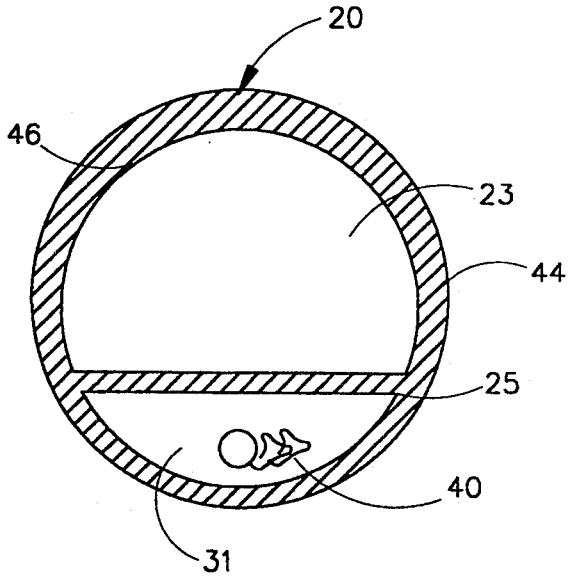
FIG. 7 is a front cross-view of the first preferred embodiment brush equipped with a heating element located in the bottom of the cylindrical tube.
Figure 8:
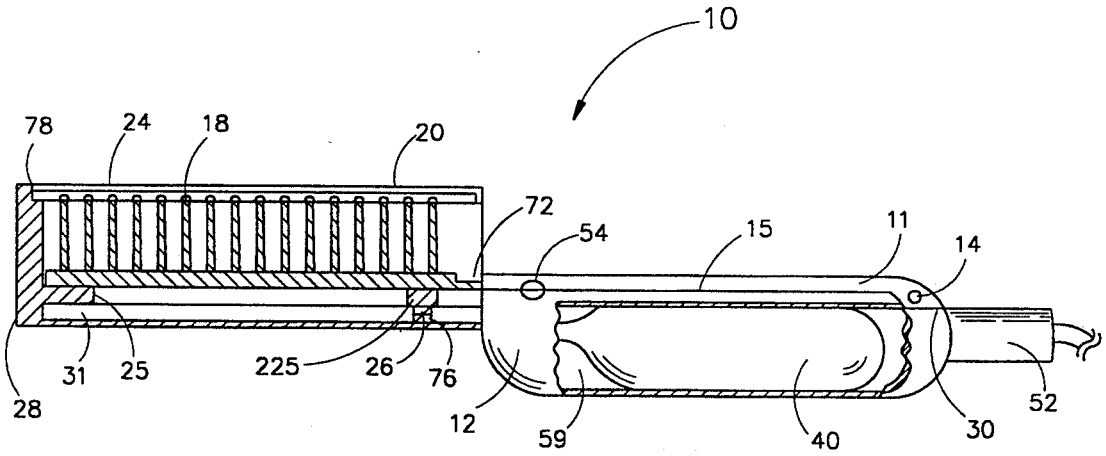
FIG. 8 is a cut-away side view of the first preferred embodiment brush equipped with a heating element which shows the hollow lower handle containing the heating element.

Tube 20 having front entrance 78 and back entrance 80 (FIG. 3), hollow cavity 23 (FIGS. 5 and 7), exterior surface 44, inner upper surface 46, and mounting element 26 (FIGS. 5 and 8). Upper inner surface 46 having front 34 and end 32. The hollow cavity having upper half and bottom half cavity 48 (FIG. 5).

Figure 1:
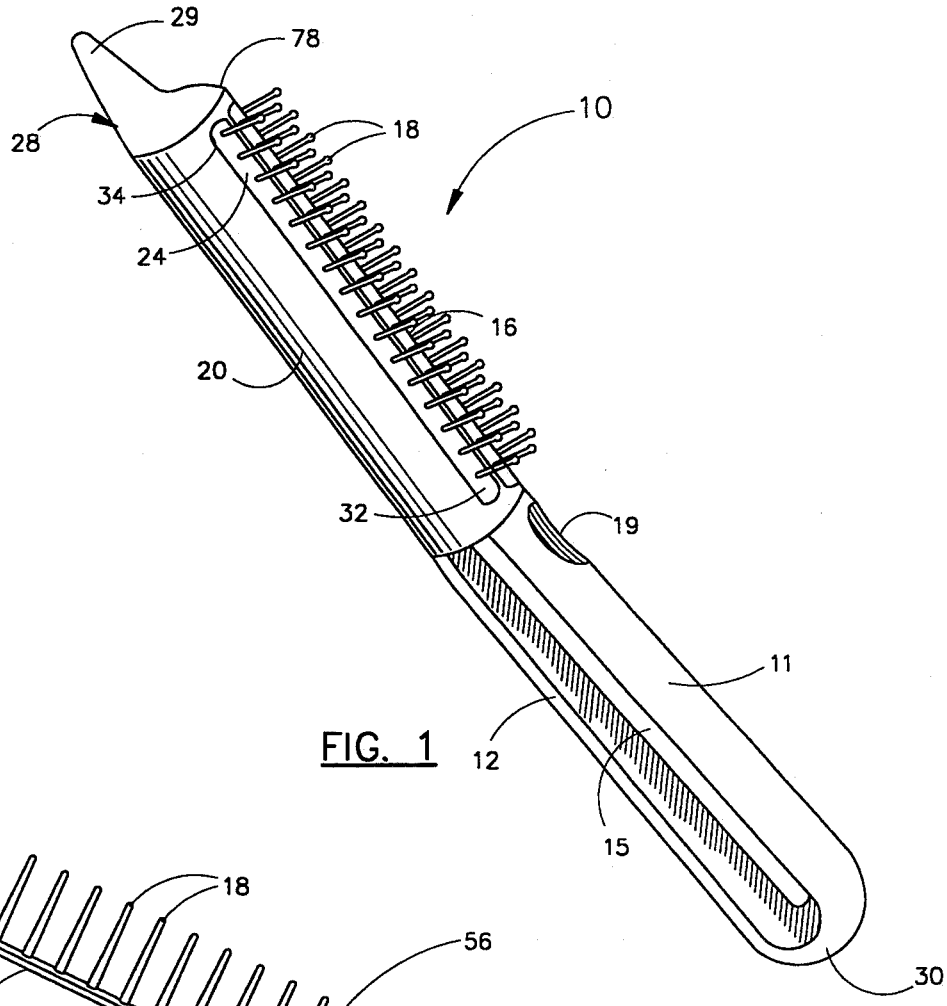
FIG. 1 is a perspective side view of the first preferred embodiment of the retractable brush with U-shape pivot, open position.
Figure 2:
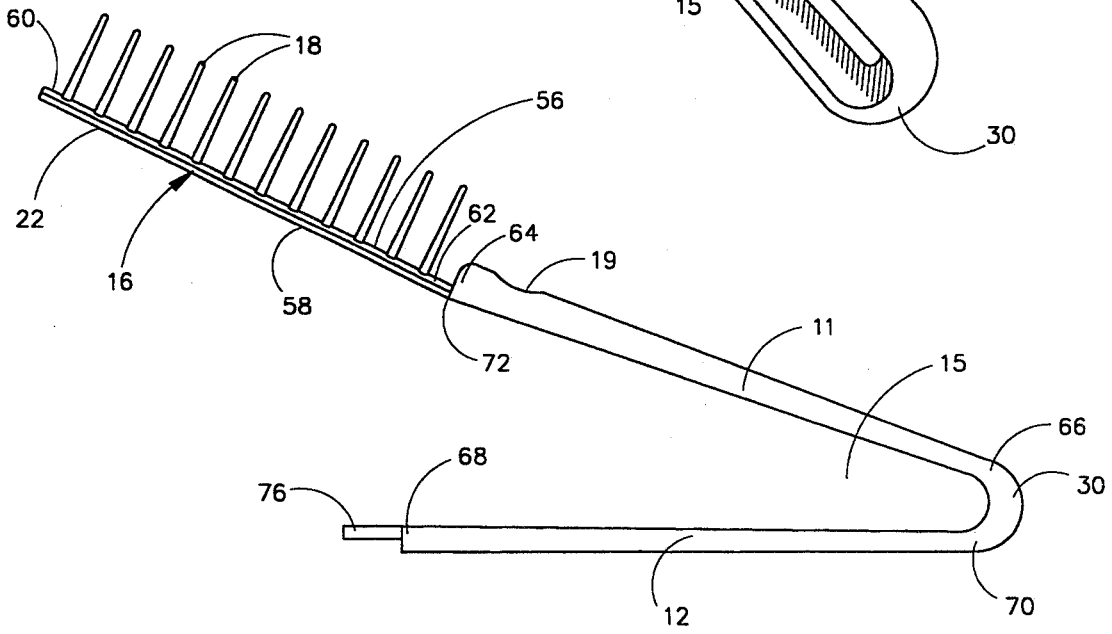
FIG. 2 is a side view of the first preferred embodiment brushing element (base and teeth) with handle (before assembled).
Figure 3:
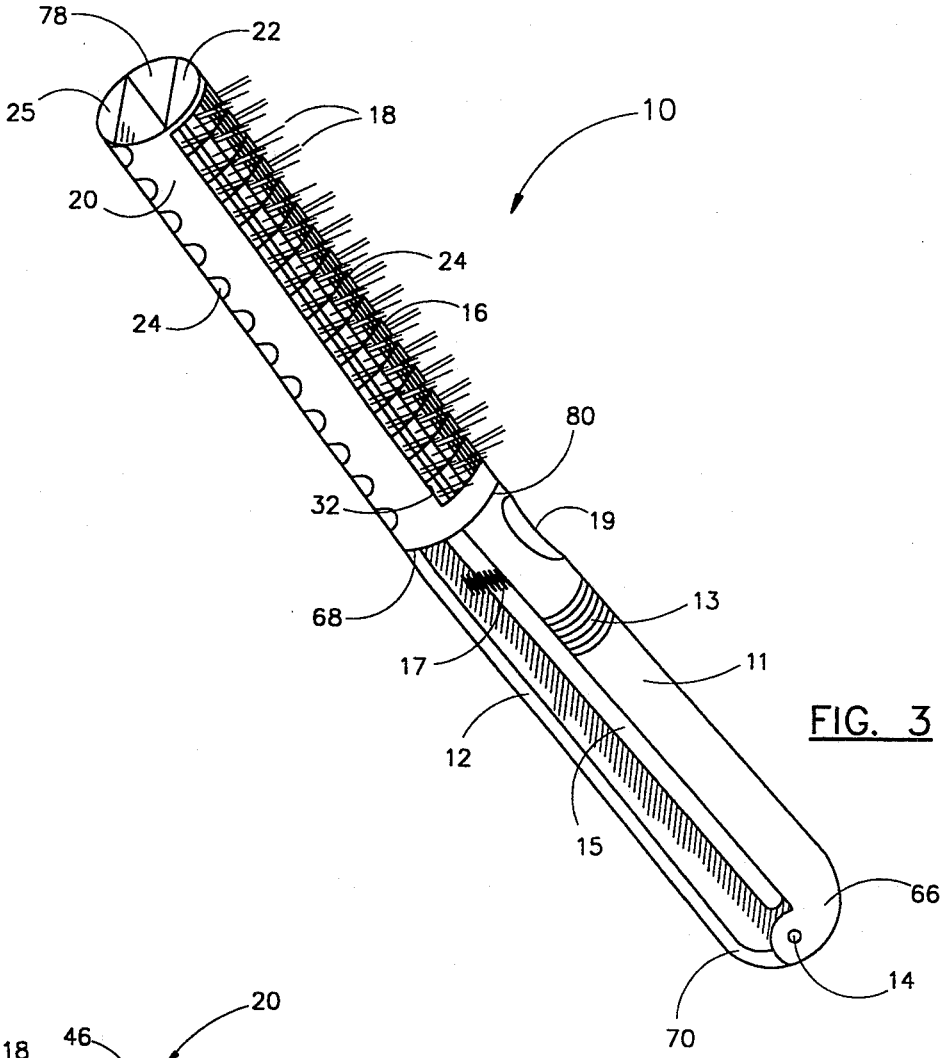
FIG. 3 is a perspective side view of the first preferred embodiment with a screen tube and bristles.

The upper handle 11 having front portion 64 and rear portion 66 (FIG. 2). The lower handle 12 having front part 68 and rear part 70 (FIG. 3). Rear portion 66 of the upper handle and rear part 70 of the lower handle are pivotally joined together by a spring, pin, bolt, hinge 14 (FIG. 3 and 8) and/or U-shape pivot connection 30 (FIGS. 1 and 2), or any other similar method of connection means.

Figure 6:
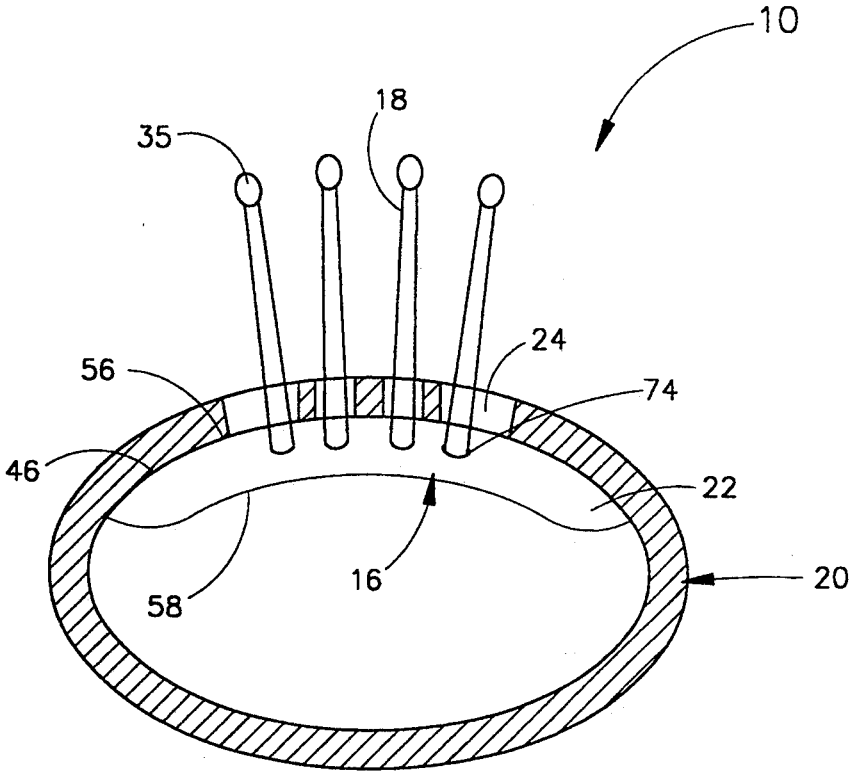
FIG. 6 is a front cross-view of the first preferred embodiment brush in the open position, generally rectangular shape tube.

The upper handle 11 carries the brushing element 16 (FIGS. 1, 2 and 6). Brushing element 16 is comprised of bristles/teeth 18 and base 22. The base 22 is comprised of upper panel 56, lower panel 58. Upper panel having front panel 60 and end panel 62 (FIG. 2). The upper panel 56 is generally raised at the central area, which means base is thinner at the sides and thicker at the center. This is because the tube 20 is generally round. This method will keep the upper base panel 56 in contact with the upper inner tube surface 46. The bristles/teeth 18 having tips and bottoms, teeth bottoms are connected to upper panel 56 of the base 22. The teeth are configured in one or more rows or teeth (three rows would be ideal). Teeth may extend bit outwardly to toward sides from the upper panel toward to teeth tips (FIGS. 1, 5 and 6). However, teeth 18 can be extend straight from bottom to tip to make ejection easier for injection molding machine.

Tube also having a series of opening 24 to accommodate the teeth 18, and may have additional openings 24 throughout the tube for air circulation (FIG. 3). The shape of the openings 24 can be rounded, rectangular, strips or any shape which will allow the bristles/teeth to protrude through the openings. Tube 20 can be made of wire mesh or screen material with a combination of plastic, metal or rubber (FIG. 3). The wire mesh material is ideal when used conjunction with natural bristles or synthetic bristles like or fabric with tines. This method will allow the bristles to protrude through the screen openings without having to be precisely aligned.

Spring force 15 will keep the brush in the open position, while bristles/teeth 18 are protruding through tube openings 24. Spring force 15 should be strong enough to hold the handles in the open position when brushing and be flexible enough to close by finger pressure.

The distance between the upper handle front portion 64 to lower handle front part 68 is wider than the inner diameter of the tube 20. This will create a flexible but strong enough spring force 15 to push up the end panel 62 of the base to closely contact with the end inner tube 32, at the same time, the front panel 60 area of the base is forcefully pushed down by inner front tube 34. When this happens, panel 60 and front tube 34 pushing each other to contact (FIG. 1).

Between the upper handle front portion 64 to end panel 62 of the base there is a adjacent connection 72. Connection 72 has a noticeable change of thickness from the handle to base, which means the base becomes thinner than handle to be flexible enough to bend down (FIG.2). Another way to make the connection 72 to bend down is having an indentation on the connection 72, only on the upper panel 56 side, but not at the bottom panel 58. So, the base will only bend down (FIG. 8), but not bend up. This method will make the whole base to bend, especially more at the front base panel 60 area. So, front panel 60 is pushed down by front tube 34 to contact each other. Also, above method will create the paralleled position with base and the tube of inner surface while in the retracting process. When fully retracted position, generally the base will reside within the bottom half cavity 48. The connection 72 is thick and stiff enough not to bend while retracting. The connection 72 only bends when open position.

When lower handle 12 is in a horizontal figure from the side view, the front panel 60 of the base is in its highest position before assembled (FIG. 2).

If there is no flexibility on the connection 72, when front panel 60 hits the front inner tube 34, end panel 62 area will not contact the inner end tube 32 (if front panel is highest position).

Without upward angle and thinner connection 72, and right amount of spring force, the teeth will protrude partially front or end of the tube surface. Also, teeth will not retract evenly.

Handles 11 and 12 remains in the open position until handle 12 is depressed by user's hand/finger(s). The handles are sufficiently substantial for better gripping. Serrations or textured cover 13 (FIG. 3) will prevent hand from slipping. The handles are preferred to be made of non-heat-conducting material such as wood, rubber or plastic. However, if it is made of metal such as oven-heating hot-irons are preferably made of metal and it should be covered with non-heat conducting material.

The upper panel 56 of the base and upper inner surface 46 of the tube should be same curve to match, so, the teeth can protrude fully. However, upper panel 56 is raised form while inner surface 46 is indented form. When they are contacted each other, they should be flush.

Device 10 can be made of hard rubber, metal, plastic (i.e. nylon, poly-carbonate). The teeth can be made of natural/synthetic bristles, metal, plastic, fabric and teeth shape can be loops, hooks, pins, or even textured. Poly-carbonate is ideal for entire 10, because this material is durable and heat-resistant, and semi-flexible with memory for springing back.

The teeth 18, base 22, and handles 11 and 12 can be injection molded in one piece, in this case teeth are tapered. Which means tips are thinner and bottoms are thicker. However, the teeth can be inserted or bonded inserting hole 74. (FIG. 6). Teeth 18 can be coated 35 with rubber or epoxy to make teeth tips smoother.

Another way to make the brush element 16 is, additional piece incorporated with the base 22 (FIG. 2). Additional piece is comprised of teeth and base, and can be injection molded with flexible material. Additional piece is secured on the upper panel of the base 22 (not shown).

Upper handle 11 may have finger impression 19, which will identify pressing area, when finger press the handle 11 to retract the teeth/bristles. Impression 19 may have non-slipping textured surface.

Lower handle 12 having securing element 76 (FIG. 2) at the front part 68 of the lower handle. Securing element 76 (FIG. 2) is securely connected to mounting element 26 (FIG. 8). Securing and mounting element can be a combination of any currently used mounting means, such as snap-on, track-slide, bonding, etc.

Figure 4:
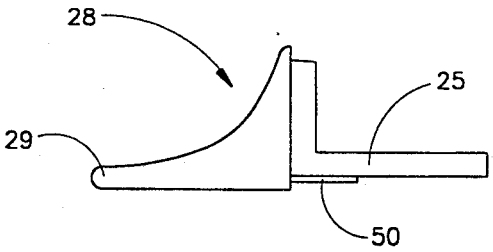
FIG. 4 is a side view of the first preferred embodiment closure with separator.

The closure cap 28 (FIGS. 1, 4 and 8) is inserted into front entrance 78 (FIGS. 3 and 8). The closure cap 28 may have stopping element 25, and may also have a separating element 29 (FIG. 4).

The stopping element 25 can be located anywhere under the lower panel 58 of the base 22 within the tube. Additional stopping element 225 may needed located under near 72 (FIG. 8). However, if bristles are used with screen, stopping element can be built in with the tube before assembled. Because bristles or fabric does not have to align with the openings 24 (FIG. 3).

Closure 28 may have a key mark, male track 50 to match with female track 49, of the bottom tube 20 (FIG. 5). However, key mark can be any kind of mark at the exterior surface of the tube 44 and outer surface of closure 28 (not shown). Key marks are beneficial to align the closure 28 to front entrance of tube 78. The spring force 15 can be also created by a independent spring 17 (FIG. 3), which may be located anywhere between the pivot 30 and the front entrance 78 of the tube. Spring 17 can be "V", "W", fan, coil, or any other shape of spring element.

The brush base 22 resides within the hollow cavity 23 of the tube (FIGS. 5 and 7). When handles 11 is pressed towards handle 12, the stopping element 25 causes the brush base 22 to stop at a position which prevents the teeth tips from becoming misaligned from the opening 24 (FIG. 5). Teeth 18 tips will be flush with the exterior surface 44 (FIG. 5) or between the exterior 44 and interior surface 46 of the tube (FIG. 5). This method will allow tube 20 to easily slide out of the curled hair and easy for cleaning.

Openings 24 allows for the circulation of hot air from the blow-dryer through tube 20, which will dry the hair faster. The bigger the openings, the better the circulation, however, openings should be moderate in size to assure tube 20 remains smooth and solid. Also, prevents the lint or hair going into inner tube.

Tube 20, when used in conjunction with heating (heated by electricity, battery, rechargeable, butane, stove heating), would be best suited to be made of a heat conducting material (such as metal or special plastics).

The tube 20 can be approximately ½" to 4" in diameter. The finished curl size depends on the size of the tube's diameter. If the brush is made for brushing purposes only, a rectangular tube which is bigger and wider could be used (FIG. 6).

Handles 11 and 12 may have a locking element 54 (FIG. 8). The locking element can be snapped in and out, or ring type, or any existing method that will close handles together and secure the bristles within the hollow cavity 23 for temporarily storage or portability.

Lower handle 12 may have a hollow cavity 59 (FIG. 8), and upper handle 11 may also have a hollow cavity (not shown). Lower tube 20 may have a hollow cavity 31 (FIG. 7). These cavities are for inserting the heating element 40 (electric, battery, butane, etc.) to heat the tube or brush base (FIGS. 7 and 8). If the heating element is electric, it should have rotatable cord 52, so cord will not twist while in use. It also may have an on and off switch (not shown).

FIGURE 9

Figure 9:
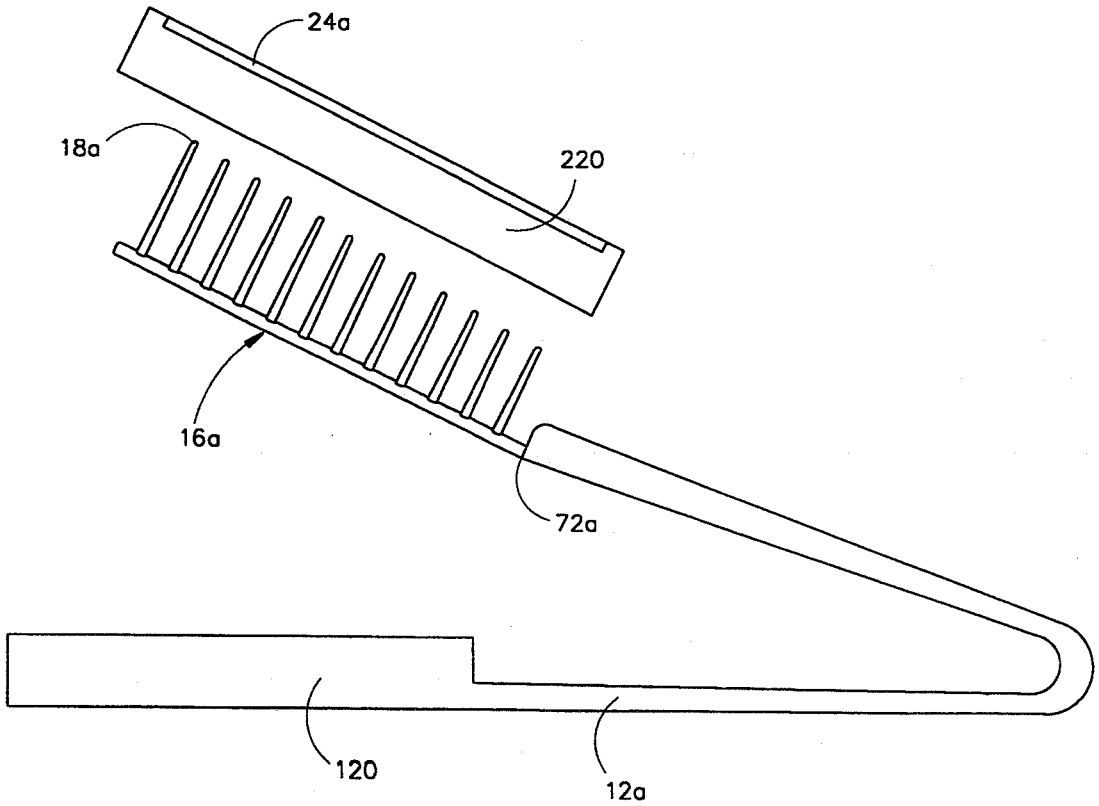
FIG. 9 is a side view of the second preferred embodiment with tube in two pieces, before assembly.

A second preferred embodiment of the improved retractable brush **10*a* is schematically depicted in FIG. 9. Device 10*a* is similar to device 10 and bear the same numerals but are succeeded by the letter "a", except as follows: Tube is made of two pieces. Half bottom tube 120 and handle 12*a* is connected and it is one piece. Half upper tube 220 is molded independently. In this case brushing element 16*a* will be inserted to upper tube 220 and tubes can be connected by connecting means such as snapping, locking, tracking, etc., (not shown) or ultrasonically welded. Stopping element is within the bottom surface of the tube 120**. Inserting independent stopping is not necessary because of tube is made of two pieces.

The teeth **18*a*** are longer at the front base area and shorter at the end base than mid area. Which means teeth are gradually getting longer towards front of the base. In this case, upward angle can be decreased at the adjacent area 72*a*.

Various modifications, changes, alterations and additions can be made in the retractable brush principle of the present invention, its components and their parameters. All such modifications, changes, alterations and additions as are within the scope of the appended claims form part of the present invention.

What is claimed is:

1. A retractable brush comprising:

a brushing base, said brushing base having first and second panels, said first panel having at least one row of teeth theron, said first panel having a first portion and a second portion;

an elongated tube, said tube having a hollow cavity, said tube having first and second ends and an exterior surface therebetween, said second end having an opening, said elongated tube having a hollow cavity and said hollow cavity having a first inner surface and a second inner surface, said first inner surface having a first face and a second face, said tube having a series of openings positioned along the exterior surface, said at least one row of teeth being positioned in said series of openings when said tube and brushing base are connected;

a first handle section and a second handle section, said first and second handle sections being joined together at one end to form a single unit and having a spring force therebetween, said spring force holding said first handle section at an acute angle relative to the second handle section when said handle sections are in an untensioned state, said first handle section being positioned adjacent said brushing base, said spring force being strong enough to push said first panel to contact said first inner surface as soon as said first portion contacts said first face of said tube, said at least one row of teeth being generally perpendicular to said base when said brushing base is not within said tube, said at least one row of teeth being slightly pointing upwardly toward said second face of said inner surface of said tube to allow for the equal length protrusion of said at least one row of teeth through said series of openings, said second handle section being connected to said tube adjacent said second end whereby when said first handle section is compressed toward said second handle section, said teeth will retract into said hollow cavity and when compression is released from said first handle section, said spring force will automatically return said teeth to a protruding position extending outwardly from the tube.

2. The retractable brush of claim 1 wherein said second handle section has a hollow cavity to insert a heating element.

3. The retractable brush of claim 1 wherein said first and second handle sections and said brushing base are injection molded of a one-piece polycarbonate material.

4. The retractable brush of claim 1 wherein said first end of said tube has a closer cap and a cap having a stopping element.

5. The retractable brush of claim 4 wherein said closer cap is also a hair separator.

* * * * *